US011600428B2

(12) United States Patent
Sato

(10) Patent No.: US 11,600,428 B2
(45) Date of Patent: Mar. 7, 2023

(54) COIL COMPONENT

(71) Applicant: Murata Manufacturing Co., Ltd., Kyoto-fu (JP)

(72) Inventor: Mitsuhiro Sato, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 513 days.

(21) Appl. No.: 16/719,683

(22) Filed: Dec. 18, 2019

(65) Prior Publication Data

US 2020/0211758 A1 Jul. 2, 2020

(30) Foreign Application Priority Data

Dec. 28, 2018 (JP) ..... JP2018-248090

(51) Int. Cl.

| | |
|---|---|
| ***H01F 27/28*** | (2006.01) |
| ***H01F 27/29*** | (2006.01) |
| ***H01F 27/255*** | (2006.01) |
| *H01F 41/04* | (2006.01) |

(52) U.S. Cl.

CPC ..... *H01F 27/2804* (2013.01); *H01F 27/255* (2013.01); *H01F 27/29* (2013.01); *H01F 41/043* (2013.01); *H01F 2027/2809* (2013.01)

(58) Field of Classification Search

None

See application file for complete search history.

(56) References Cited

U.S. PATENT DOCUMENTS

| | | | | |
|---|---|---|---|---|
| 11,009,574 | B2 * | 5/2021 | Yoshinaka | G01R 33/341 |
| 11,127,528 | B2 * | 9/2021 | Tsuduki | H01F 27/28 |
| 2006/0006972 | A1 * | 1/2006 | Tozawa | H01F 27/292 336/200 |
| 2016/0351315 | A1 | 12/2016 | Park et al. | |
| 2017/0372829 | A1 * | 12/2017 | Nagai | H01F 17/0033 |
| 2018/0182531 | A1 | 6/2018 | Muneuchi et al. | |
| 2019/0027288 | A1 * | 1/2019 | Sato | H01F 5/04 |
| 2019/0198210 | A1 * | 6/2019 | Suzuki | H01F 1/33 |

(Continued)

FOREIGN PATENT DOCUMENTS

| | | | |
|---|---|---|---|
| CN | 108231339 | A | 6/2018 |
| JP | 2015-177185 | A | 10/2015 |

(Continued)

OTHER PUBLICATIONS

An Office Action; "Notice of Reasons for Refusal," mailed by the Japanese Patent Office dated Sep. 21, 2021, which corresponds to Japanese Patent Application No. 2018-248090 and is related to U.S. Appl. No. 16/719,683 with English translation.

(Continued)

*Primary Examiner* — Jermele M Hollington

(74) *Attorney, Agent, or Firm* — Studebaker & Brackett PC

(57) ABSTRACT

A coil component includes an element body including a magnetic portion containing metal particles and a coil conductor embedded in the magnetic portion, and at least a pair of outer electrodes disposed on the element body and electrically connected to the coil conductor. The magnetic portion includes a region A containing metal particles having a relatively small average particle size and a region B containing metal particles having a relatively large average particle size. The region A is present between outer electrodes of the pair of outer electrodes and the coil conductor.

21 Claims, 5 Drawing Sheets

(56) References Cited

U.S. PATENT DOCUMENTS

| | | | | |
|---|---|---|---|---|
| 2020/0111609 | A1* | 4/2020 | Sato | H01F 41/046 |
| 2021/0304951 | A1* | 9/2021 | Maruyama | H01F 41/046 |
| 2022/0108835 | A1* | 4/2022 | Nagai | H01F 1/28 |

FOREIGN PATENT DOCUMENTS

| | | | |
|---|---|---|---|
| JP | 2016-225604 | A | 12/2016 |
| JP | 2017-011042 | A | 1/2017 |
| JP | 2018-107199 | A | 7/2018 |

OTHER PUBLICATIONS

An Office Action; "Notice of Reasons for Refusal," mailed by the Japanese Patent Office dated Apr. 27, 2021, which corresponds to Japanese Patent Application No. 2018-248090 and is related to U.S. Appl. No. 16/719,683 with English language translation.

* cited by examiner

COIL COMPONENT

CROSS-REFERENCE TO RELATED APPLICATION

This application claims benefit of priority to Japanese Patent Application No. 2018-248090, filed Dec. 28, 2018, the entire content of which is incorporated herein by reference.

BACKGROUND

Technical Field

The present disclosure relates to a coil component.

Background Art

Various inventive efforts have been made to improve the electrical characteristics of coil components. For example, according to Japanese Unexamined Patent Application Publication No. 2015-177185, the electrical characteristics, such as direct current (DC) superposition characteristics and DC resistance, of a multilayer coil component are improved by setting the particle size of metal particles used in a magnetic layer of the coil component to be within a predetermined range.

SUMMARY

To improve the reliability of a coil component such as described above, an element body of the coil component is required to have high withstand voltage. However, a coil component such as described in Japanese Unexamined Patent Application Publication No. 2015-177185 does not have sufficient insulation particularly between a coil conductor and outer electrodes thereof.

Accordingly, the present disclosure provides a coil component having high insulation between a coil conductor and outer electrodes thereof.

Preferred embodiments of the present disclosure include the following aspects.

(1) A coil component including an element body including a magnetic portion containing metal particles and a coil conductor embedded in the magnetic portion and at least a pair of outer electrodes disposed on the element body and electrically connected to the coil conductor. The magnetic portion includes a region A containing metal particles having a relatively small average particle size and a region B containing metal particles having a relatively large average particle size, and the region A is present between outer electrodes of the pair of outer electrodes and the coil conductor.

(2) The coil component according to (1) above, wherein the coil component is a multilayer coil component.

(3) The coil component according to (1) or (2) above, wherein the pair of outer electrodes are disposed on opposing end surfaces of the element body, and the coil conductor is disposed such that an axis thereof is aligned with an up-down direction of the element body.

(4) The coil component according to any one of (1) to (3) above, wherein an average particle size of metal particles in the region B is 1.1 times or more and 30 times or less (i.e., from 1.1 times to 30 times) an average particle size of metal particles in the region A.

(5) The coil component according to any one of (1) to (4) above, wherein an average particle size of metal particles in the region A is 1.0 μm or more and 2.0 μm or less (i.e., from 1.0 μm to 2.0 μm).

(6) The coil component according to any one of (1) to (5) above, wherein an average particle size of metal particles in the region A is 1.0 μm or more and 2.0 μm or less (i.e., from 1.0 μm to 2.0 μm), and an average particle size of metal particles in the region B is 2.0 μm or more and 20.0 μm or less (i.e., from 2.0 μm to 20.0 μm).

(7) The coil component according to any one of (1) to (6) above, wherein the region B is present at least in a region located above the coil conductor and in a region located below the coil conductor.

(8) The coil component according to any one of (1) to (7) above, wherein the outer electrodes of the pair of outer electrodes are five-surface electrodes.

(9) The coil component according to (8) above, wherein the region A is regions extending from end surfaces of the magnetic portion to planes spanning ends of the outer electrodes of the pair of outer electrodes.

(10) The coil component according to any one of (1) to (9) above, wherein both the region A and the region B are present in a region extending from end surfaces of the magnetic portion to a coiled wire portion of the coil conductor.

(11) The coil component according to any one of (1) to (9) above, wherein, in plan view from above, the region A is regions extending from end surfaces of the magnetic portion to portions beyond ends of a coiled wire portion of the coil conductor.

(12) The coil component according to any one of (1) to (8) above, wherein, in plan view from above, a thickness of a center of the region A is smaller than a thickness of both ends of the region A.

According to the present disclosure, because of using metal particles having a relatively small average particle size between a coil conductor of the element body and outer electrodes, a coil component having high insulation between the coil conductor and the outer electrodes can be provided.

Other features, elements, characteristics, and advantages of the present disclosure will become more apparent from the following detailed description of preferred embodiments of the present disclosure with reference to the attached drawings.

DETAILED DESCRIPTION

Hereafter, a coil component according to one of the embodiments of the present disclosure will be described in detail with reference to the drawings. However, the illustrated examples do not limit the form, arrangement, or other particulars of the coil component or each element thereof according to the present embodiment.

First Embodiment

Figure 1:
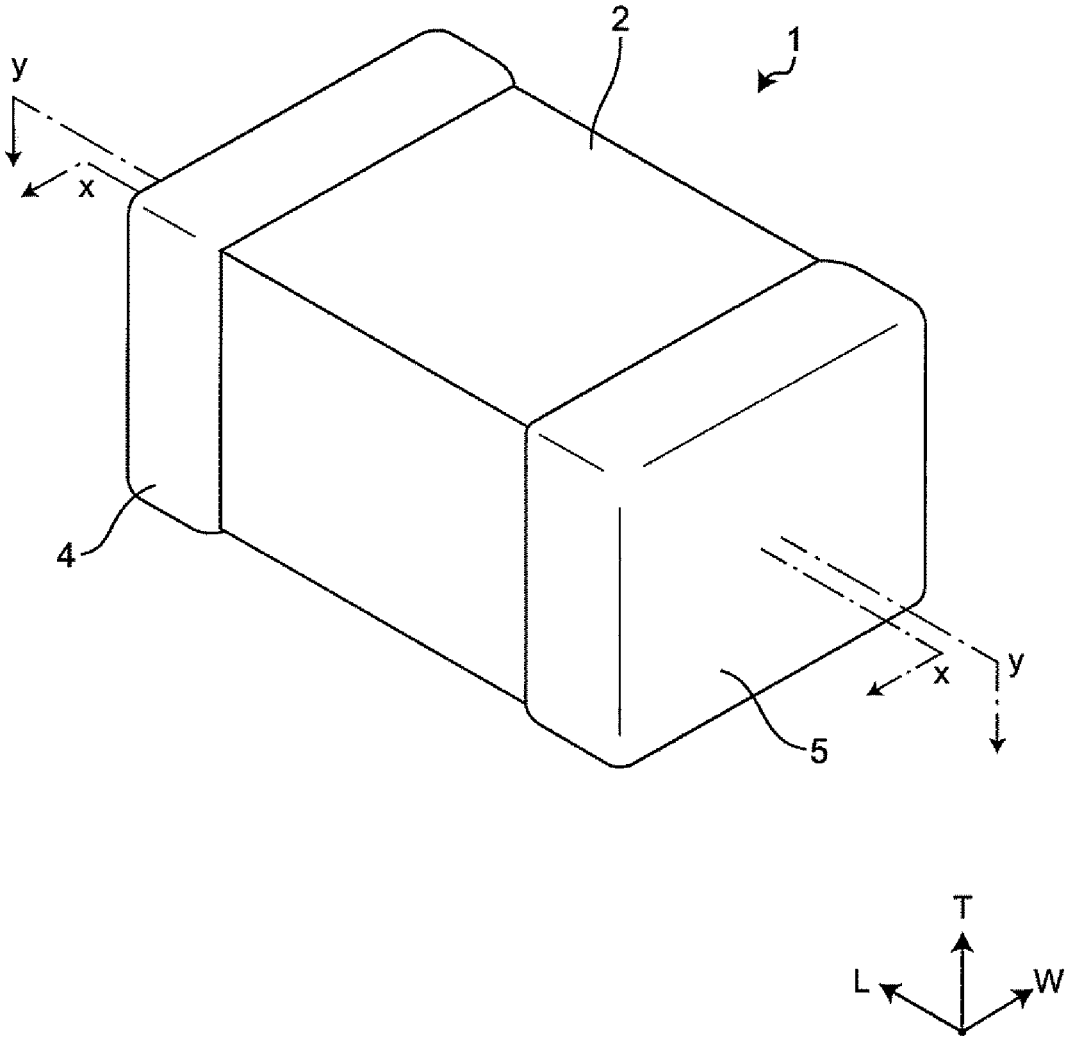
FIG. 1 is a perspective view schematically illustrating a coil component according to the present disclosure.
Figure 2A:
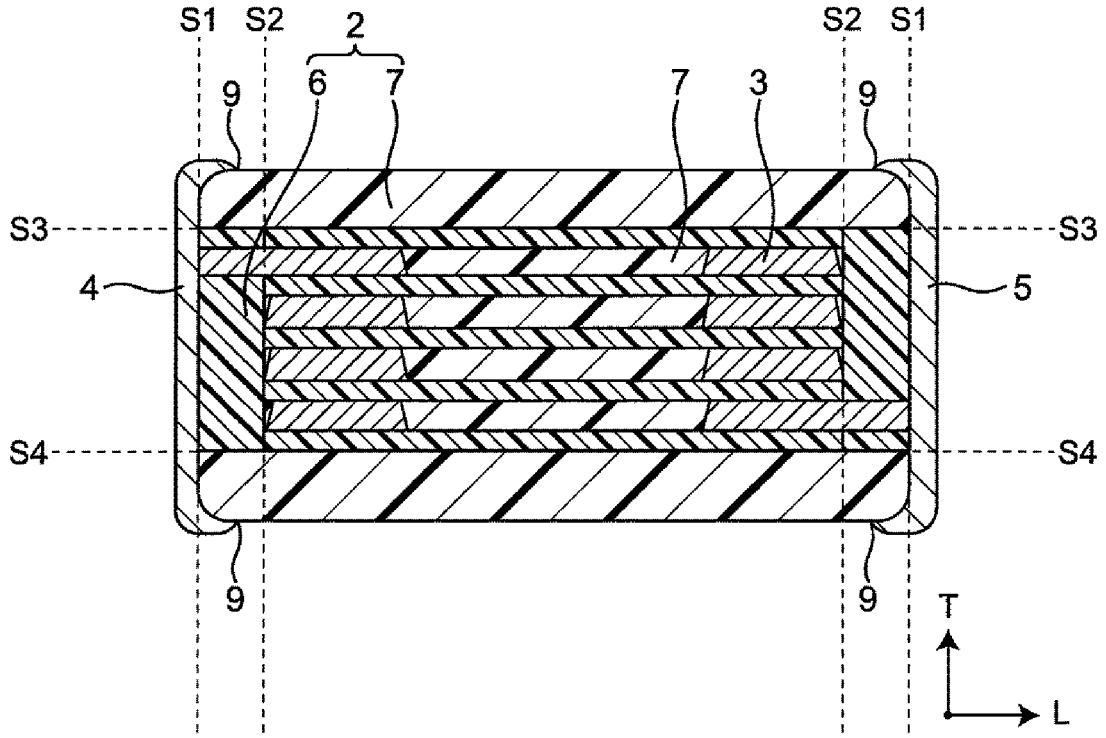
FIG. 2A is a sectional view of a coil component according to a first embodiment of the present disclosure along line x-x in FIG. 1.
Figure 2B:
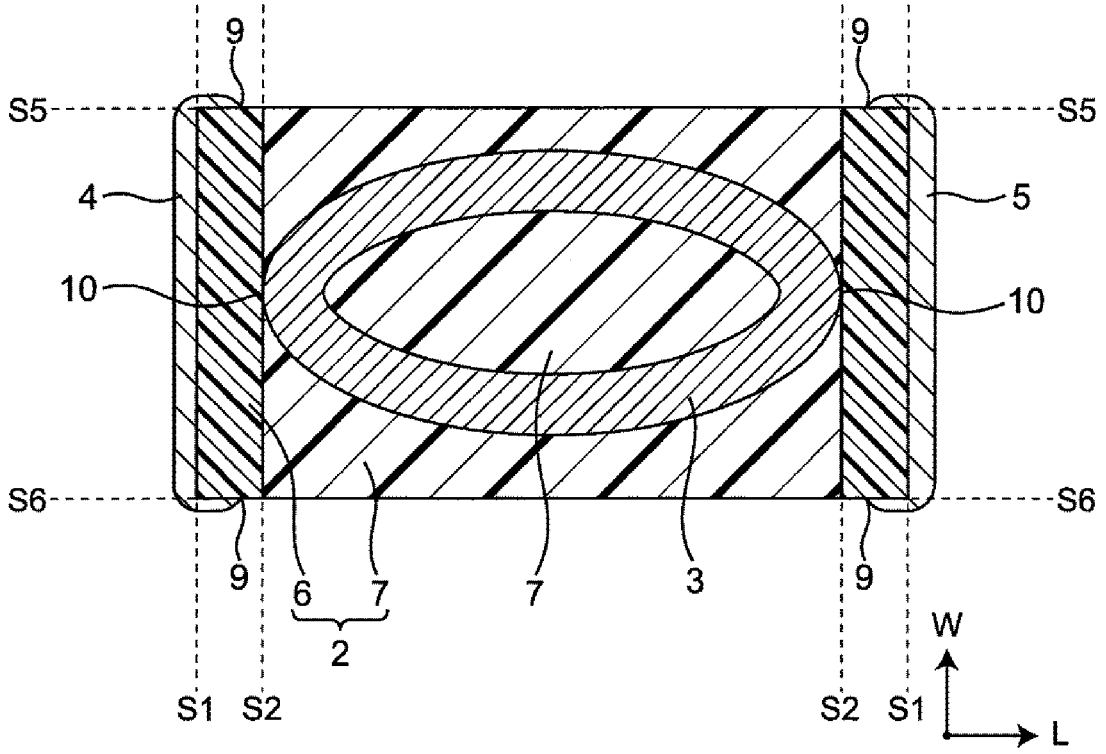
FIG. 2B is a sectional view of the coil component along line y-y in FIG. 1.

A coil component 1 according to the present embodiment is schematically illustrated in a perspective view in FIG. 1, in a sectional view along line x-x in FIG. 2A, and in a sectional view along line y-y in FIG. 2B. However, the illustrated examples do not limit the form, arrangement, or other particulars of the coil component or each element thereof according to the following embodiment.

As illustrated in FIGS. 1, 2A, and 2B, the coil component 1 according to the present embodiment is a multilayer coil component having a substantially rectangular parallelepiped form. With regard to the coil component 1, a plane perpendicular to the L axis in FIG. 1 is referred to as an "end surface", a plane perpendicular to the W axis in FIG. 1 is referred to as a "lateral surface", an upper plane perpendicular to the T axis in FIG. 1 is referred to as an "upper surface", and a lower plane perpendicular to the T axis in FIG. 1 is referred to as a "lower surface". Schematically, the coil component 1 has a magnetic portion 2, a coil conductor 3 embedded in the magnetic portion 2, and a pair of outer electrodes 4 and 5 electrically connected to the coil conductor 3. In the present specification, a combination of the magnetic portion 2 and the coil conductor 3 is also referred to as an "element body".

As illustrated in FIGS. 2A and 2B, the magnetic portion 2 is constituted by a region A (denoted by reference number 6 in the figures) and a region B (denoted by reference number 7 in the figures). The region A is a region containing metal particles having a relatively small average particle size. The region B is a region containing metal particles having a relatively large average particle size. As illustrated in FIGS. 2A and 2B, the region A is present near each of the outer electrodes. The region A is a region surrounded by planes S1 and S2 which are T-W planes, planes S3 and S4 which are L-W planes, and planes S5 and S6 which are L-T planes. Furthermore, the region A corresponds to each magnetic layer sandwiched between coil conductor layers. The planes S1 which are near the outer electrodes fit over the end surfaces of the magnetic portion 2, and the planes S2 which are near the coil conductor 3 are located in contact with ends 10 of a coiled wire portion of the coil conductor 3. The plane S3 which is an upper plane is located between the upper end of the coil conductor 3 and the upper end of the magnetic portion 2, and the plane S4 which is a lower plane is located between the lower end of the coil conductor 3 and the lower end of the magnetic portion 2. The planes S5 and S6 which are located near the lateral surfaces of the magnetic portion 2 fit over the lateral surfaces of the magnetic portion 2. As illustrated in FIGS. 2A and 2B, the region B is a region extending from the plane S3 of the region A to the upper end of the magnetic portion 2 and a region extending from the plane S4 of the region A to the lower end of the magnetic portion 2. The region B is also present inside the coiled core of the coil conductor 3 and in the same layers as the coil conductor layers.

The coil conductor 3 is positioned such that the coil axis is aligned with the up-down direction (i.e., T direction) of the coil component 1. Both ends of the coil conductor 3 extend to the end surfaces of the magnetic portion 2 and are electrically connected therefrom to the outer electrodes 4 and 5. The coil conductor 3 is formed with plural coil conductor layers being layered with vias (not illustrated) interposed therebetween.

The magnetic portion 2 is constituted by the region A and the region B.

The region A contains metal particles having a relatively small average particle size and the region B contains metal particles having a relatively large average particle size. In other words, the average particle size of metal particles contained in the region A is smaller than the average particle size of metal particles contained in the region B.

The term "average particle size" refers to the average of the equivalent circle diameters of metal particles in scanning electron microscope (SEM) images of a section of the magnetic portion 2. For example, the average particle size can be determined as follows. Images of plural (e.g., five) regions (e.g., 130 μm×100 μm each) of a section of the coil component 1 are captured by using a SEM, the captured SEM images are analyzed by using image analysis software (e.g., A-Zou Kun™, manufactured by Asahi Kasei Engineering Corporation), the equivalent circle diameters of 500 or more metal particles are found, and the average thereof is calculated.

In an aspect, the average particle size of metal particles in the region B is 1.1 times or more and 30 times or less (i.e., from 1.1 times to 30 times) the average particle size of metal particles in the region A, preferably 2.0 times or more and 20 times or less (i.e., from 2.0 times to 20 times), more preferably 5.0 times or more and 15 times or less (i.e., from 5.0 times to 15 times). The average particle size of metal particles in the region A and the average particle size of metal particles in the region B set in a range such as described above enable a combination of a higher level of insulation and a higher level of magnetic permeability.

In an aspect, the average particle size of metal particles in the region A is 1.0 μm or more and 2.0 μm or less (i.e., from 1.0 μm to 2.0 μm), preferably 1.2 μm or more and 1.8 μm or less (i.e., from 1.2 μm to 1.8 μm). The average particle size of metal particles in the region A set to 2.0 μm or less results in higher insulation in the region A. A further decrease in the average particle size increases specific resistance in the region A, which, in other words, results in even higher insulation in the region A. The average particle size of metal particles in the region A set to 1.0 μm or more increases magnetic permeability in the region A, thereby ensuring high inductance even with a decreased thickness of the region A (i.e., distance between the planes S1 and S2). A further increase in the average particle size increases magnetic permeability in the region A, thereby ensuring higher inductance.

In an aspect, the average particle size of metal particles in the region B is 2.0 μm or more and 20.0 μm or less (i.e., from 2.0 μm to 20.0 μm), preferably 4.0 μm or more and 20.0 μm or less (i.e., from 4.0 μm to 20.0 μm), more preferably 8.0 μm or more and 20.0 μm or less (i.e., from 8.0 μm to 20.0 μm). The average particle size of metal particles in the region B set to 2.0 μm or more results in higher magnetic permeability in the region B. A further increase in the average particle size results in even higher magnetic permeability in the region B. The average particle size of metal particles in the region B set to 20.0 μm or less enables a decreased alternating current (AC) loss. A further decrease in the average particle size enables a further decrease in the AC loss.

In an aspect, the average particle size of metal particles in the region A is 1.0 μm or more and 2.0 μm or less (i.e., from 1.0 μm to 2.0 μm), preferably 1.2 μm or more and 1.8 μm or less (i.e., from 1.2 μm to 1.8 μm). The average particle size of metal particles in the region B is 2.0 μm or more and 20.0 μm or less (i.e., from 2.0 μm to 20.0 μm), preferably 4.0 μm or more and 20.0 μm or less (i.e., from 4.0 μm to 20.0 μm), more preferably 8.0 μm or more and 20.0 μm or less (i.e., from 8.0 μm to 20.0 μm). The average particle size of metal particles in the region B is 1.1 times or more and 30 times or less (i.e., from 1.1 times to 30 times) the average particle size of metal particles in the region A, preferably 2.0 times or more and 20 times or less (i.e., from 2.0 times to 20 times), more preferably 5.0 times or more and 15 times or less (i.e., from 5.0 times to 15 times). The average particle size of metal particles in the region A and the average particle size of metal particles in the region B set in a range such as described above enable a combination of a higher level of insulation and a higher level of magnetic permeability.

In a preferred aspect, the coefficient of variation (CV) of the above-described metal particles is 30% or less, preferably 20% or less. Metal particles having a CV in such a range have relatively uniform particle size. The lower limit of the CV of the above-described metal particles is not particularly limited and can be, for example, 1% or more, 5% or more, or 10% or more. A CV set to 30% or less enables further improved insulation in the region A and even higher magnetic permeability in the region B. A further decrease in the CV results in still further improved insulation in the region A and still even higher magnetic permeability in the region B. A CV set to 1% or more enables an improved packing density of the metal particles and further improved magnetic permeability in both the region A and in the region B.

The term "CV" refers to a value calculated by the following formula.

$$CV\ (\%)=(\sigma/Ave)\times 100$$

In the formula, "Ave" denotes an average particle size, and σ denotes a standard deviation of particle size.

The metal material forming the metal particles is not particularly limited, and examples of such a metal material include iron, cobalt, nickel, gadolinium and alloys containing one or more of these, preferably iron and iron alloys. The iron may be iron as a metal or derivatives (e.g., complexes) thereof. The iron derivatives are not particularly limited, and examples of such an iron derivative include carbonyl iron, which is a complex of iron and CO, preferably pentacarbonyl iron, particularly preferably hard-grade carbonyl iron having an onion-skin structure (a structure in which concentric spherical layers are formed from the center of a particle), of which an example is hard-grade carbonyl iron manufactured by BASF Societas Europaea. The iron alloys are not particularly limited, and examples of such an iron alloy include Fe—Si alloys, Fe—Si—Cr alloys, Fe—Si—Al alloys, Fe—Ni alloys, Fe—Co alloys, and Fe—Si—B—Nb—Cu alloys. The alloys may further contain B, C, and the like as accessory components. The content of such accessory components is not particularly limited and can be, for example, 0.1 wt % or more and 5.0 wt % or less (i.e., from 0.1 wt % to 5.0 wt %), preferably 0.5 wt % or more and 3.0 wt % or less (i.e., from 0.5 wt % to 3.0 wt %). The metal materials may be one or more. The metal material in the region A and the metal material in the region B may be the same or different but are preferably the same.

Each of the metal particles may be coated with a coating formed of an insulating material (hereafter, also simply referred to as an "insulating coating"). Coating the surface of each of the metal particles with an insulating coating improves insulation between the particles, thereby improving insulation in the magnetic portion 2.

When coated, the surface of each of the metal particles is simply required to be coated with an insulating coating to the extent that enables higher insulation between the particles. Specifically, the surface of each of the metal particles may be coated simply in part with the insulating coating. The insulating coating may have any form, examples of which include a mesh form and a layer form. In a preferred aspect, the insulating coating may coat 30% or more, preferably 60% or more, more preferably 80% or more, even more preferably 90% or more, particularly preferably 100% of the region of the surface of each of the metal particles.

According to the present disclosure, the insulating coating in the region A and the insulating coating in the region B may be the same or different.

In an aspect, the insulating coating may be an oxide coating formed on the surface of each metal particle.

In another aspect, the insulating coating may be formed of an insulating material containing Si. Insulating materials containing Si include, for example, a silicon compound such as $SiO_x$ (where x is 1.5 or more and 2.5 or less (i.e., from 1.5 to 2.5), typically $SiO_2$). Because an insulating coating formed of an insulating material containing Si has high strength, coating each metal particle with an insulating coating containing Si enables higher strength in the metal particle.

In still another aspect, the insulating coating may be formed of an insulating coating material containing phosphoric acids or phosphoric acid residues (specifically, P═O groups).

The phosphoric acids are not particularly limited and examples thereof include organic phosphoric acids represented by the formula $(R^2O)P(=O)(OH)_2$ or $(R^2O)_2P(=O)OH$. In the formulas, $R^2$ each independently represents a hydrocarbon group. $R^2$ is a group of preferably 5 atoms or more, more preferably 10 atoms or more, even more preferably 20 atoms or more in chain length. $R^2$ is also a group of preferably 200 atoms or less, more preferably 100 atoms or less, even more preferably 50 atoms or less in chain length.

The hydrocarbon group is preferably a substituted or unsubstituted alkyl ether group or a substituted or unsubstituted phenyl ether group. Examples of substituents include alkyl groups, a phenyl group, polyoxyalkylene groups, polyoxyalkylene styryl groups, and polyoxyalkylene alkyl groups, and unsaturated polyoxyethylene alkyl groups.

The organic phosphoric acids may be in the form of phosphates. The cations in such phosphates are not particularly limited, and examples of such cations include $NH_4$+, amine ions, ions of alkali metals such as Li, Na, K, Rb, and Cs, ions of alkaline earth metals such as Be, Mg, Ca, Sr, and Ba, and ions of other metals such as Cu, Zn, Al, Mn, Ag, Fe, Co, and Ni. The countercation is preferably $Li^+$, $Na^+$, $K^+$, or $NH_4^+$, or an amine ion.

In a preferable aspect, the organic phosphoric acids may be any of polyoxyalkylene styrylphenyl ether phosphoric acid, polyoxyalkylene alkyl ether phosphoric acid, polyoxyalkylene alkyl aryl ether phosphoric acid, alkyl ether phosphoric acid, and unsaturated polyoxyethylene alkyl phenyl ether phosphoric acid, or salts of any of these organic phosphoric acids.

The coating method for the insulating coating is not particularly limited and may be performed by applying any coating process known to those skilled in the art, such as a sol-gel process, a mechanochemical process, a spray drying process, a fluidized bed granulation process, an atomization process, or a barrel sputtering process.

The thickness of the insulating coating is not particularly limited but is preferably 1 nm or more and 100 nm or less (i.e., from 1 nm to 100 nm), more preferably 3 nm or more and 50 nm or less (i.e., from 3 nm to 50 nm), even more preferably 5 nm or more and 30 nm or less (i.e., from 5 nm to 30 nm). For example, the thickness of the insulating coating can be 10 nm or more and 30 nm or less (i.e., from 10 nm to 30 nm) or 5 nm or more and 20 nm or less (i.e., from 5 nm to 20 nm). A further increase in the thickness of such an insulating coating enables higher insulation in the magnetic portion 2. On the other hand, a further decrease in the thickness of such an insulating coating enables a further increase in the content of a metal material in the magnetic portion 2, thereby improving the magnetic characteristics in the magnetic portion 2 and facilitating downsizing of the magnetic portion 2.

In an aspect, the thickness of an insulating coating of each metal particle in the region A is larger than the thickness of an insulating coating of each metal particle in the region B.

The magnetic portion 2 can contain a resin material in addition to metal particles.

The resin material is not particularly limited, and examples thereof include thermosetting resins such as epoxy resin, phenolic resin, polyester resin, polyimide resin, and polyolefin resin. Such resin materials may be one or more.

In the coil component 1 according to the present disclosure, the region A is interposed between the outer electrode 4 and the coil conductor 3 and between the outer electrode 5 and the coil conductor 3. The region A having relatively high insulation located between the outer electrode 4 and the coil conductor 3 and between the outer electrode 5 and the coil conductor 3 enables higher insulation between the outer electrodes 4 and 5 and the coil conductor 3.

As illustrated in FIGS. 2A and 2B, the region A of the coil component 1 is a region surrounded by the planes S1 which fit over the end surfaces of the magnetic portion 2, the planes S2 which are parallel to the end surfaces of the magnetic portion 2 and in contact with the ends 10 of the coiled wire portion of the coil conductor 3, the plane S3 which is substantially parallel to the upper surface of the magnetic portion 2 and which is located between the upper surface of the coil conductor 3 and the upper surface of the magnetic portion 2, the plane S4 which is substantially parallel to the lower surface of the magnetic portion 2 and which is located between the lower surface of the coil conductor 3 and the lower surface of the magnetic portion, and the planes S5 and S6 which fit over both lateral surfaces of the magnetic portion 2 (excluding a region having a portion from which the coil conductor 3 is extended). Furthermore, the region A corresponds to each layer sandwiched between the coil conductor layers.

The region A located as described above makes the region A always present between the outer electrode 4 and the coil conductor 3 and the outer electrode 5 and the coil conductor 3 except for in connectors of the outer electrodes 4 and 5 and the coil conductor 3. The region A located as described above enables higher insulation between the outer electrodes 4 and 5 and the coil conductor 3. Furthermore, the region A corresponding to each layer sandwiched between the coil conductor layers of the coil conductor 3 enables higher insulation between coiled wires in the coil conductor 3.

The thickness of the region A located between the outer electrode 4 and the coil conductor 3 and between the outer electrode 5 and the coil conductor 3 (i.e., the distance between the planes S1 and S2) is preferably 40 μm or more and 130 μm or less (i.e., from 40 μm to 130 μm), more preferably 40 μm or more and 100 μm or less 9 i.e., from 40 μm to 100 μm). The thickness set to 40 μm or more further ensures insulation between the outer electrodes 4 and 5 and the coil conductor 3. A further increase in the thickness enables even higher insulation between the outer electrodes 4 and 5 and the coil conductor 3. Furthermore, the thickness set to 130 μm or less ensures an increase in the size of a region where the coil conductor 3 is disposed, thereby enabling a further increase in inductance of the coil conductor 3. A further decrease in the thickness enables a further increase in the size of the region where the coil conductor 3 is disposed.

The thickness of the region A which corresponds to each layer sandwiched between the coil conductor layers of the coil conductor 3 (thickness in the layering direction) can preferably be 8 μm or more and 15 μm or less (i.e., from 8 μm to 15 μm), more preferably 9 μm or more and 10 μm or less (i.e., from 9 μm to 10 μm).

The thickness of the region A located above the coil conductor 3 (i.e., the distance between the upper surface of the coil conductor 3 and the plane S3) and the thickness of the region A located below the coil conductor 3 (i.e., the distance between the lower surface of the coil conductor 3 and the plane S4) are not particularly limited and can be each independently and preferably 40 μm or more and 130 μm or less (i.e., from 40 μm to 130 μm), more preferably 40 μm or more and 100 μm or less (i.e., from 40 μm to 100 μm).

As illustrated in FIGS. 2A and 2B, the region B is present in a region between the plane S3 and the upper surface of the magnetic portion 2 and in a region between the plane S4 and the lower surface of the magnetic portion 2. Furthermore, as illustrated in FIGS. 2A and 2B, the region B is also present in the coiled core of the coil conductor 3 and in the same layers as the coil conductor layers. In other words, the region B is present in an upper region, a lower region, and an inner region of the coil conductor 3. The region B having relatively high magnetic permeability and located in such parts where a magnetic flux emanating from the coil conductor 3 passes improves the inductance of the coil component 1.

The region A and the region B located in a manner as in the coil component 1 improve insulation at a location in the magnetic portion 2 where high insulation is required, enabling improved magnetic permeability at a location in the magnetic portion 2 where high magnetic permeability is required and enabling a combination of a high level of withstand voltage and a high level of inductance of the coil component 1.

The coil conductor 3 is formed with plural coil conductor layers layered with vias interposed therebetween. As illustrated in FIGS. 2A and 2B, the coil conductor 3 is coiled in an oval shape, and the ends of the coil conductor 3 extend to both end surfaces of the magnetic portion 2 and are exposed. The coil conductor 3 is electrically connected to the outer electrodes 4 and 5 at the end surfaces of the magnetic portion 2.

The material forming the coil conductor 3 is not particularly limited as long as the material has electrical conductivity, and general electroconductive materials such as Ag and Cu may be used. Those skilled in the art can select an electroconductive material for use as appropriate while considering factors such as the use, the composition of the magnetic portion 2, and the firing temperature.

The outer electrodes 4 and 5 are disposed throughout the end surfaces, on a portion of both lateral surfaces, on a portion of the upper surface, and on a portion of the lower surface of the element body. In other words, the outer electrodes 4 and 5 are disposed on the end surfaces of the element body and extend from the end surfaces of the element body to a portion of planes adjacent thereto. The outer electrodes 4 and 5 are commonly known as five-surface electrodes.

Ends 9 of the outer electrode 4 and the ends 9 of the outer electrode 5 are respectively positioned on the respective outer electrode 4 side and outer electrode 5 side of the respective planes S2. In other words, a plane spanning the end portions of the outer electrode 4 and a plane spanning the end portions of the outer electrode 5 are located on the respective outer electrode 4 side and outer electrode 5 side of the coil conductor-side ends of the region A. The region A located extending further inward from the ends 9 of the outer electrode 4 and from the ends 9 of the outer electrode 5 (i.e., near the coil conductor) enables further improved insulation of the coil component 1.

The outer electrodes 4 and 5 are formed of an electroconductive material, which is preferably one or more selected from the group consisting of Au, Ag, Pd, Ni, Sn, and Cu.

The outer electrodes 4 and 5 may be single layer or multilayer. In an aspect, when being multilayer, each of the outer electrodes 4 and 5 can include a layer containing Ag or Cu, a layer containing Ni, or a layer containing Sn. In a preferred aspect, each of the outer electrodes 4 and 5 is formed of a layer containing Ag or Cu, a layer containing Ni, and a layer containing Sn. The layers are preferably arranged from the coil conductor side in the order of the layer containing Ag or Cu, the layer containing Ni, and the layer containing Sn. Preferably, the layer containing Ag or Cu can be a layer of a baked-on Ag paste or a baked-on Cu paste and the layer containing Ni and the layer containing Sn can be plating layers.

The coil component 1 according to the present disclosure can be downsized with good electrical characteristics thereof being maintained. In an aspect, the coil component 1 has a length (L) of preferably 0.95 mm or more and 1.75 mm or less (i.e., from 0.95 mm to 1.75 mm), more preferably 0.95 mm or more and 1.55 mm or less (i.e., from 0.95 mm to 1.55 mm). In an aspect, the coil component 1 has a width (W) of preferably 0.45 mm or more and 0.95 mm or less (i.e., from 0.45 mm to 0.95 mm), more preferably 0.45 mm or more and 0.75 mm or less (i.e., from 0.45 mm to 0.75 mm). In a preferred aspect, the coil component 1 has a length (L) of 0.95 mm or more and 1.75 mm or less (i.e., from 0.95 mm to 1.75 mm) and a width (W) of 0.45 mm or more and 0.95 mm or less (i.e., from 45 mm to 0.95 mm), preferably a length (L) of 0.95 mm or more and 1.55 mm or less (i.e., from 0.95 mm to 1.55 mm) and a width (W) of 0.45 mm or more and 0.75 mm or less (i.e., from 0.45 mm to 0.75 mm). In an aspect, the coil component 1 has a height (or thickness (T)) of preferably 0.80 mm or less, more preferably 0.70 mm or less.

The coil component 1 according to the present disclosure can be produced by using a method similar to an existing method for producing a multilayer coil component except for the part involving the region A and the region B located as a magnetic portion. The coil component 1 according to the present disclosure can be produced by using, for example, the following method.

First, a magnetic sheet A forming the region A and a magnetic sheet B forming the region B are prepared. A magnetic paste A forming the region A and a magnetic paste B forming the region B are also prepared. Additionally, a conductive paste forming the coil conductor is prepared.

Next, a predetermined position of the magnetic sheet A is laser-irradiated to form a via hole. The via hole is filled with a portion of the conductive paste prepared above, after which another portion of the conductive paste is applied to the magnetic sheet A by screen printing to form a coil pattern. Subsequently, the magnetic paste A and the magnetic paste B are respectively applied to the exterior of the coil pattern and the interior of the coil pattern, which are some of the regions where the conductive paste is not applied, to form a magnetic sheet C where the coil pattern corresponding to each layer is applied.

A predetermined number of the magnetic sheet B and a predetermined number of the magnetic sheet C are layered in a predetermined order and thermally pressure bonded to form a multilayer block. The resulting multilayer block is cut into individual elements by using a dicer. The individual elements of the multilayer block (multilayer elements) are then fired. Next, the fired elements are immersed in a resin under reduced pressure to be impregnated with the resin, and the resin is thermally cured. Subsequently, the formation of outer electrodes on the end surfaces of an element body formed of the elements can yield the coil component as illustrated in FIG. 1.

Second Embodiment

Figure 3A:
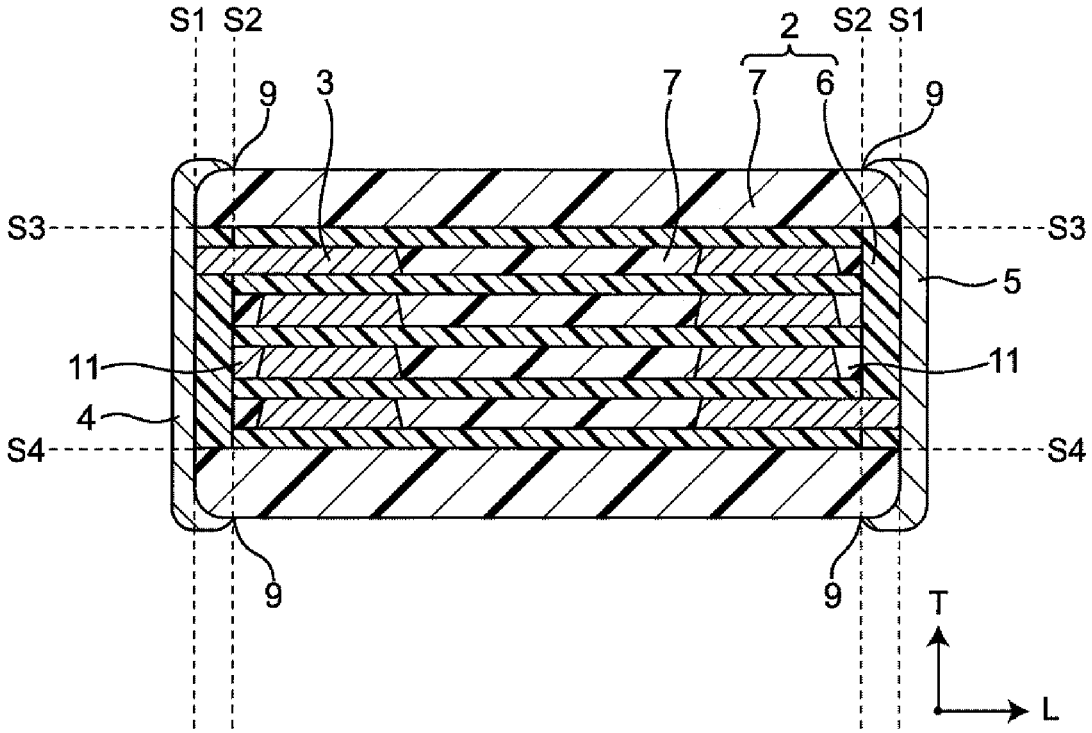
FIG. 3A is a sectional view of a coil component according to a second embodiment of the present disclosure along line x-x in FIG. 1.
Figure 3B:
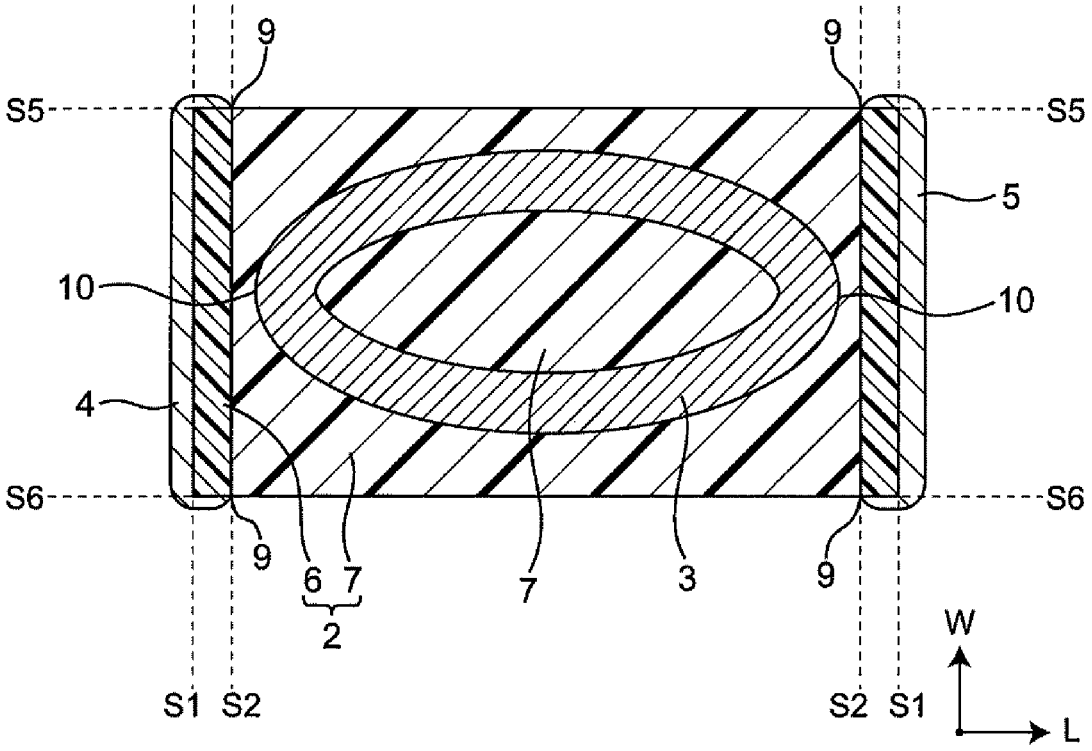
FIG. 3B is a sectional view of the coil component along line y-y in FIG. 1.

As illustrated in FIGS. 3A and 3B, a coil component according to a second embodiment has a structure similar to the structure of the coil component 1 according to the first embodiment except for the following. In the coil component according to the second embodiment, the ends 9 of the outer electrode 4 and the ends 9 of the outer electrode 5 are respectively positioned on the respective end surface sides of the magnetic portion 2 of the coiled wire portion of the coil conductor 3. The region A is a region extending from one of the end surfaces of the magnetic portion 2 to a plane spanning the ends 9 of the outer electrode 4 and a region extending from the other of the end surfaces of the magnetic portion 2 to a plane spanning the ends 9 of the outer electrode 5. Furthermore, the region A corresponds to each layer sandwiched between the coil conductor layers. The region B is present in a region 11 extending between the coil conductor 3 in layers where the coil conductor layers are present and the region A as well as in the region B in the coil component 1 according to the first embodiment. In other words, both the region A and the region B are present in a region extending from the end surfaces of the magnetic portion 2 to the coiled wire portion of the coil conductor 3. The region A is present in a region extending from one of the end surfaces of the magnetic portion 2 to a plane spanning the ends 9 of the outer electrode 4 and a region extending from the other of the end surfaces of the magnetic portion 2 to a plane spanning the ends 9 of the outer electrode 5.

In the coil component according to the present embodiment, the planes S2 of the region A and planes spanning the ends of the outer electrodes 4 and 5 are located on the respective end surface sides of the coil component of the coiled wire portion of the coil conductor 3. This arrangement enables the region B (11) to be located between the coil conductor 3 and the planes S2 of the region A. The presence of the region B (11) enables a further increased inductance of the coil component. Furthermore, the planes spanning the ends of the outer electrodes 4 and 5 are not present on the coil conductor 3 sides of the planes S2, which accordingly also enables higher insulation between the outer electrodes 4 and 5 and the coil conductor 3.

Third Embodiment

Figure 4A:
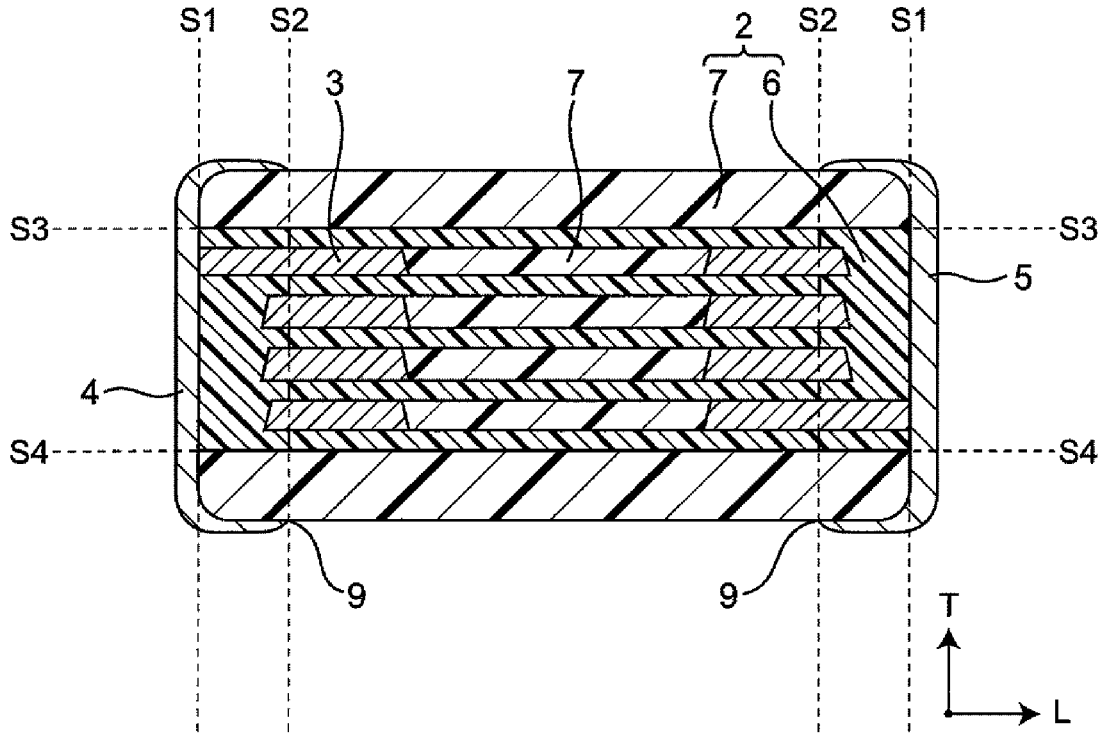
FIG. 4A is a sectional view of a coil component according to a third embodiment of the present disclosure along line x-x in FIG. 1.
Figure 4B:
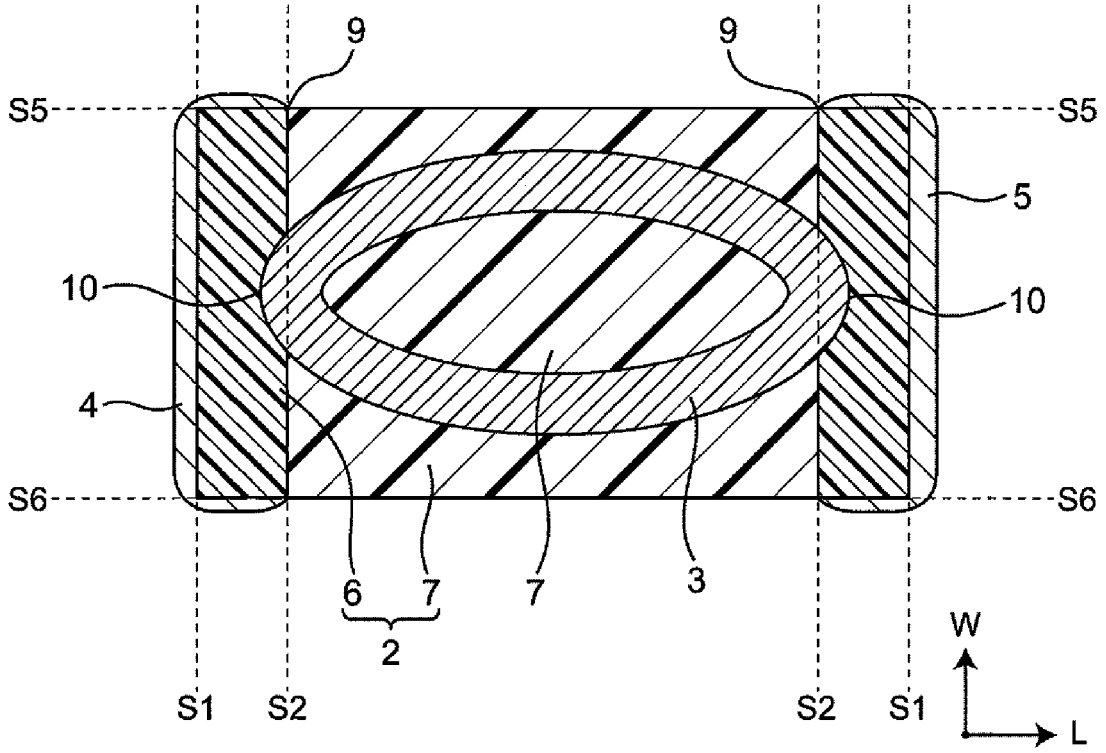
FIG. 4B is a sectional view of the coil component along line y-y in FIG. 1.

As illustrated in FIGS. 4A and 4B, a coil component according to a third embodiment has a structure similar to the structure of the coil component 1 according to the first embodiment except for the following. In the coil component according to the third embodiment, the region A is regions extending from the end surfaces of the magnetic portion 2 to positions beyond the ends 10 of the coiled wire portion of the coil conductor 3. Furthermore, the region A corresponds to each layer sandwiched between the coil conductor layers. In other words, in plan view from above, the region A is present in a region extending from the end surfaces of the magnetic portion 2 to beyond the ends 10 of the coiled wire portion of the coil conductor 3. That is, the planes S2 of the region A are present further inward from the ends 10 of the coiled wire portion of the coil conductor 3. Likewise, the ends 9 of the outer electrode 4 and the ends 9 of the outer electrode 5 are present further inward from the ends 10 of the coiled wire portion of the coil conductor 3.

The coil component according to the present embodiment enables an increased thickness of the region A that is present in end surface portions of the magnetic portion 2, which accordingly further enables improved insulation between the electrodes 4 and 5 and the coil conductor 3.

Fourth Embodiment

Figure 5A:
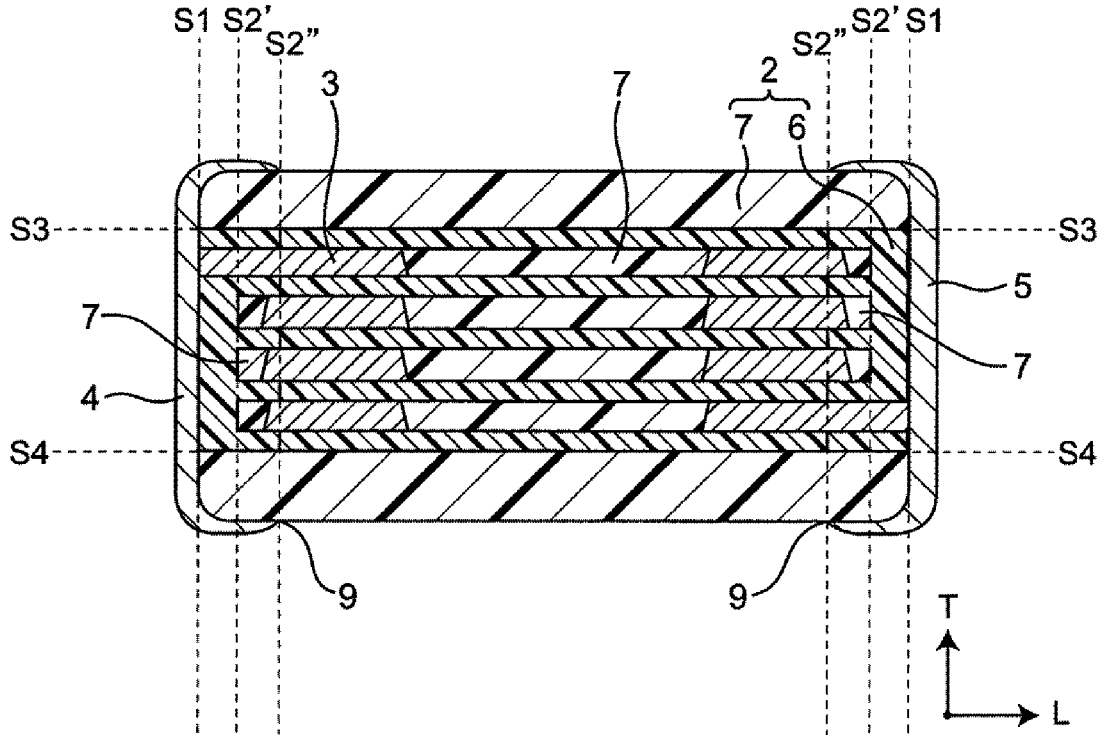
FIG. 5A is a sectional view of a coil component according to a fourth embodiment of the present disclosure along line x-x in FIG. 1.
Figure 5B:
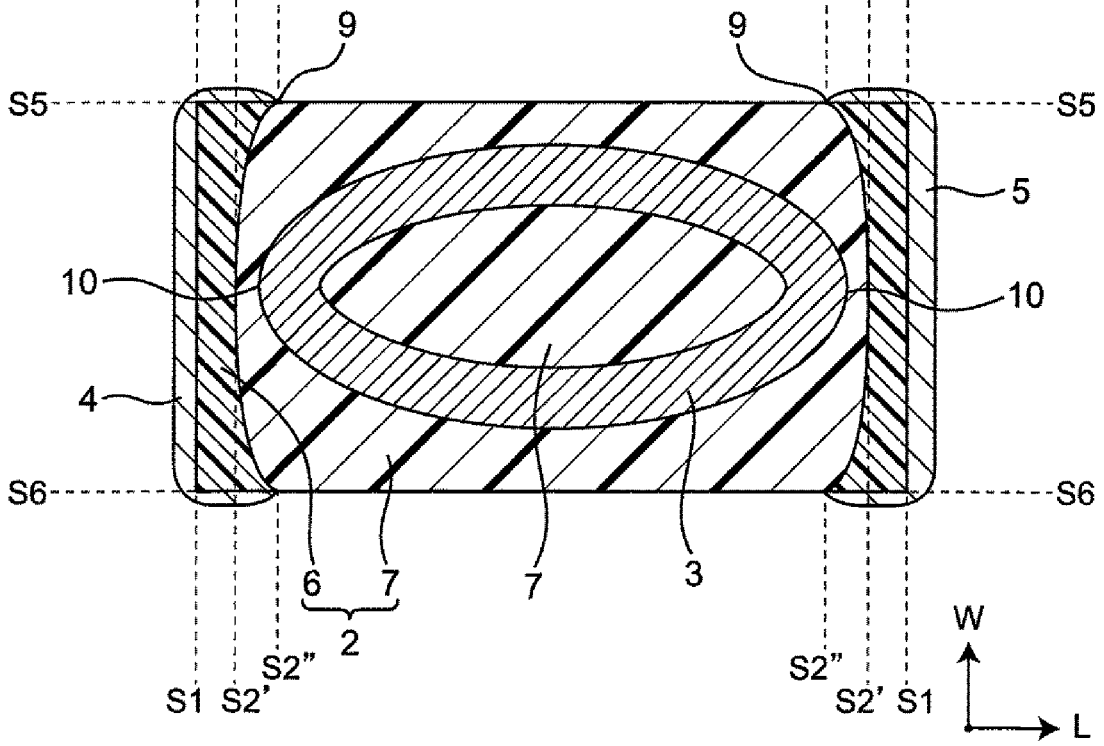
FIG. 5B is a sectional view of the coil component along line y-y in FIG. 1.

As illustrated in FIGS. 5A and 5B, a coil component according to a fourth embodiment has a structure similar to the structure of the coil component according to the third embodiment except for the following. In the coil component according to the fourth embodiment, in plan view from above (i.e., from the layering direction), the coil conductor-side planes of the region A are curved toward the end surfaces of the magnetic portion 2. In other words, the planes corresponding to the planes S2 of the coil component according to the third embodiment are curved toward the planes S1. That is, in plan view of the coil component from the layering direction, the thickness of the center of the region A is smaller than the thickness of both ends of the region A (i.e., the thickness of the region A on the lateral surfaces of the magnetic portion 2).

The coil component according to the present embodiment enables improved inductance thereof, due to having the region B between the coil conductor 3 and the outer electrodes 4 and 5.

The distance between each plane S2' including the vertex of each curved plane and each of the planes S1 can preferably be 40 μm or more and 130 μm or less (i.e., from 40 μm to 130 μm), more preferably 40 μm or more and 100 μm or less (i.e., from 40 μm to 100 μm).

The distance between each plane ST including the vertex of the curved plane and each plane S2" can preferably be 20 μm or more and 150 μm or less (i.e., from 20 μm to 150 μm), more preferably 50 μm or more and 100 μm or less (i.e., from 50 μm to 100 μm).

The distance between each plane ST including the vertex of the curved plane and each of the ends 10 of the coiled wire portion of the coil conductor 3 can preferably be 10 μm or more and 150 μm or less (i.e., from 10 μm to 150 μm), more preferably 30 μm or more and 100 μm or less (i.e., from 30 μm to 100 μm).

While embodiments of the coil component according to the present disclosure have been described above, the coil component according to the present disclosure is not limited thereto and various modifications can be made.

For example, the coil component may be covered with a protective layer except for the outer electrodes 4 and 5.

Examples of an insulating material forming the protective layer include resin materials having high electrical insulation such as acrylic resin, epoxy resin, and polyimide resin.

While the coil component and a production method thereof according to the present disclosure have been described above, the above-described embodiments do not limit the present disclosure and changes in design can be made within the scope that does not depart from the gist of the present disclosure.

EXAMPLES

Example 1

Magnetic Sheet

Fe—Si magnetic alloy powder having a median diameter (D50) of 1.5 μm was prepared and mixed with predetermined amounts of a binder resin, a dispersant, and an organic solvent. The resulting mixture was formed into a sheet by using the doctor blade method to form a magnetic sheet. Likewise, another magnetic sheet was formed from Fe—Si magnetic alloy powder having a D50 of 5 μm. Hereafter, the sheet having a D50 of 1.5 μm is referred to as a "magnetic sheet A" and the sheet having a D50 of 5 μm is referred to as a "magnetic sheet B".

Magnetic Paste

Fe—Si magnetic alloy powder having a D50 of 1.5 μm was prepared, a predetermined amount of a binder resin, a predetermined amount of a plasticizer, and a predetermined amount of an organic solvent were added thereto, and the resulting mixture was kneaded to form a magnetic paste. Likewise, Fe—Si magnetic alloy powder having a D50 of 5 μm was prepared, a predetermined amount of a binder resin, a predetermined amount of a plasticizer, and a predetermined amount of an organic solvent were added thereto, and the resulting mixture was kneaded to form a magnetic paste. Hereafter, the paste having a D50 of 1.5 μm is referred to as a "magnetic paste A" and the paste having a D50 of 5 μm is referred to as a "magnetic paste B".

Conductive Paste

A Ag paste containing Ag as a main component was prepared as a conductive paste.

Formation of Magnetic Sheet with Coil Pattern Applied Thereto by Screen Printing A predetermined position of the magnetic sheet A prepared above was laser-irradiated to form a via hole, and the via hole was filled with a portion of the Ag paste. Next, another portion of the Ag paste was applied to the magnetic sheet A by screen printing to form a coil pattern. Subsequently, the magnetic paste A and the magnetic paste B were applied to form a magnetic paste layer in regions where the paste was not applied. Specifically, the magnetic paste A was applied to a region extending from the ends of the Ag paste to a location corresponding to the end surfaces of an element body, and the magnetic paste B was applied to a region excluding the region. Thus, plural magnetic sheets (hereafter "magnetic sheets C") where the coil patterns corresponding to each layer were screen-applied were formed.

Formation of Multilayer Block

A predetermined number of the magnetic sheet B serving as a cover layer, a predetermined number of the magnetic sheets C obtained as described above, and a predetermined number of the magnetic sheet B serving as a cover layer were layered in a predetermined order and thermally pressure bonded to form a multilayer block.

Formation of Coil Component

The multilayer block obtained as described above was cut into individual elements by using a dicer. The individual elements of the multilayer block (multilayer elements) were barrel-finished to round the corners of the elements. Next, the elements were heat treated at a temperature of 700° C. and fired, after which the fired elements were immersed in epoxy resin under a reduced pressure of 1 Pa or less to be impregnated with the epoxy resin. After being air dried, the epoxy resin was thermally cured. Subsequently, a resin paste containing Ag was applied to the end surfaces of an element body formed of the elements and the resin paste was cured to form base electrodes. A Ni plating layer and a Sn plating layer were formed in order on the base electrodes by using an electroless plating process to form outer electrodes, thereby yielding a coil component (exemplary sample) illustrated in FIG. 1.

Comparative Example 1

A coil component in Comparative Example 1 (comparative exemplary sample) was obtained as in Example 1 except that the magnetic sheet B and the magnetic paste B were used in place of the magnetic sheet A and the magnetic paste A, in other words, that only the magnetic sheet B and the magnetic paste B were used.

Evaluation

Withstand Voltage Test

A withstand voltage test in which pulse voltage of 25 V was applied 300 times to 50 of the obtained exemplary samples and 50 of the obtained comparative exemplary samples was conducted. The withstand voltage test demonstrated that while a short circuit did not occur in the exemplary samples, a short circuit did occur in the comparative exemplary samples.

The coil component according to the present disclosure can be used, for example, as an inductor, in wide-ranging and various applications.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A coil component comprising:

an element body including a magnetic portion containing metal particles and a coil conductor embedded in the magnetic portion; and at least a pair of outer electrodes disposed on the element body and electrically connected to the coil conductor, wherein the magnetic portion includes a region A containing metal particles having a relatively small average particle size and a region B containing metal particles having a relatively large average particle size, the region A is present between outer electrodes of the pair of outer electrodes and the coil conductor, and in an extension direction of an axis of the coil conductor, the region A extends throughout an entire thickness of the coil conductor.

2. The coil component according to claim 1, wherein the coil component is a multilayer coil component.

3. The coil component according to claim 1, wherein the pair of outer electrodes are disposed on opposing end surfaces of the element body, and the coil conductor is disposed such that the axis thereof is aligned with an up-down direction of the element body.

4. The coil component according to claim 1, wherein an average particle size of metal particles in the region B is from 1.1 times to 30 times an average particle size of metal particles in the region A.

5. The coil component according to claim 1, wherein an average particle size of metal particles in the region A is from 1.0 μm to 2.0 μm.

6. The coil component according to claim 1, wherein an average particle size of metal particles in the region A is from 1.0 μm to 2.0 μm, and an average particle size of metal particles in the region B is from 2.0 μm to 20.0 μm.

7. The coil component according to claim 1, wherein the region B is present at least in a region located above the coil conductor and in a region located below the coil conductor.

8. The coil component according to claim 1, wherein the outer electrodes of the pair of outer electrodes are five-surface electrodes.

9. The coil component according to claim 8, wherein the region A is regions extending from end surfaces of the magnetic portion to planes spanning ends of the outer electrodes of the pair of outer electrodes.

10. The coil component according to claim 1, wherein both the region A and the region B are present in a region extending from end surfaces of the magnetic portion to a coiled wire portion of the coil conductor.

11. The coil component according to claim 1, wherein, in plan view from above, the region A is regions extending from end surfaces of the magnetic portion to portions beyond ends of a coiled wire portion of the coil conductor.

12. The coil component according to claim 1, wherein, in plan view from above, a thickness of a center of the region A is smaller than a thickness of both ends of the region A.

13. The coil component according to claim 2, wherein the pair of outer electrodes are disposed on opposing end surfaces of the element body, and the coil conductor is disposed such that an axis thereof is aligned with an up-down direction of the element body.

14. The coil component according to claim 2, wherein an average particle size of metal particles in the region B is from 1.1 times to 30 times an average particle size of metal particles in the region A.

15. The coil component according to claim 2, wherein an average particle size of metal particles in the region A is from 1.0 μm to 2.0 μm.

16. The coil component according to claim 2, wherein an average particle size of metal particles in the region A is from 1.0 μm to 2.0 μm, and an average particle size of metal particles in the region B is from 2.0 μm to 20.0 μm.

17. The coil component according to claim 2, wherein the region B is present at least in a region located above the coil conductor and in a region located below the coil conductor.

18. The coil component according to claim 2, wherein the outer electrodes of the pair of outer electrodes are five-surface electrodes.

19. The coil component according to claim 2, wherein both the region A and the region B are present in a region extending from end surfaces of the magnetic portion to a coiled wire portion of the coil conductor.

20. The coil component according to claim 2, wherein, in plan view from above, the region A is regions extending from end surfaces of the magnetic portion to portions beyond ends of a coiled wire portion of the coil conductor.

21. The coil component according to claim 1, wherein the region A is present between a first plane and a second plane, the first plane extending in the extension direction along an end portion of the magnetic portion adjacent to one of the outer electrodes, the second plane extending in the extension direction along ends of a coiled wire portion of the coil conductor that face the first plane.

* * * * *